US006621488B1

(12) United States Patent
Takeuchi et al.

(10) Patent No.: US 6,621,488 B1
(45) Date of Patent: Sep. 16, 2003

(54) IMAGE DISPLAY DEVICE AND MODULATION PANEL THEREFOR

(75) Inventors: Kesatoshi Takeuchi, Shiojiri (JP); Takahiro Sagawa, Chino (JP)

(73) Assignee: Seiko Epson Corporation, Tokyo (JP)

( * ) Notice: Subject to any disclaimer, the term of this patent is extended or adjusted under 35 U.S.C. 154(b) by 265 days.

(21) Appl. No.: 09/645,584

(22) Filed: Aug. 25, 2000

(30) Foreign Application Priority Data

Aug. 26, 1999 (JP) ..... 11-239035

(51) Int. Cl.[7] ..... G09G 5/00
(52) U.S. Cl. ..... 345/204; 345/87
(58) Field of Search ..... 345/87, 88, 89, 345/90, 98–100, 76, 82, 84, 204, 93

(56) References Cited

U.S. PATENT DOCUMENTS 5,043,917 A * 8/1991 Okamoto ..... 345/550
5,416,496 A * 5/1995 Wood ..... 345/102
5,566,010 A * 10/1996 Ishii et al. ..... 345/58
5,977,942 A * 11/1999 Walker et al. ..... 345/102
6,175,351 B1 * 1/2001 Matsuura et al. ..... 345/98
6,239,780 B1 * 5/2001 Walker et al. ..... 345/102

FOREIGN PATENT DOCUMENTS

JP 56-27198 3/1981
JP 7-56143 3/1995
JP 2000-056334 2/2000
JP 2000-148065 5/2000
JP 2000-19988/5 * 7/2000

* cited by examiner

*Primary Examiner*—Richard Hjerpe
*Assistant Examiner*—Alexander Eisen
(74) *Attorney, Agent, or Firm*—Oblon, Spivak, McClelland, Maier & Neustadt, P.C.

(57) ABSTRACT

A single-plate modulation panel comprises, for each pixel, a drive signal storage section for storing the drive signals corresponding to three colors used during the individual modulation of three-color illumination light; a color selection section for selecting one of the drive signals for the three colors stored in the drive signal storage section; and a modulation-executing section for performing modulation in accordance with the drive signals selected by the color selection section. Three light sources are controlled such that the single-plate modulation panel is illuminated with three-color illumination light in a recurring fashion one color at a time. In addition, the color selection section is controlled such that one of the drive signals corresponding to the three colors stored in the drive signal storage section is applied to the modulation-executing section while being switched in synchronism with the lighting timing of three-color illumination light.

11 Claims, 11 Drawing Sheets

INDIVIDUAL CELL OF LIQUID-CRYSTAL PANEL PERTAINING TO FIRST EMBODIMENT

INDIVIDUAL CELL OF CONVENTIONAL LIQUID-CRYSTAL PANEL

INDIVIDUAL CELL OF LIQUID-CRYSTAL PANEL PERTAINING TO SECOND EMBODIMENT

FOURTH EMBODIMENT

IMAGE DISPLAY DEVICE AND MODULATION PANEL THEREFOR

BACKGROUND OF THE INVENTION

1. Field of the Invention

The present invention relates to a technique for displaying color images using modulation panels.

2. Description of the Related Art

Projection-type display devices constitute a class of image display devices for displaying color images. In projection-type display devices, images are displayed based on a principle such that light emitted by an optical illumination system is modulated in accordance with a video signal by means of a liquid-crystal light bulb or other modulation panel, and the modulated light is projected onto a screen. The modulation panels are also referred to as "electrooptical devices" because of the use of the electrooptical effect.

Color-enabled projection-type display devices often require three liquid-crystal light bulbs because of the need to modulate three-color (RGB) images. Fairly complex optical systems are needed, however, for projection type display devices having three liquid-crystal light bulbs. A demand therefore has existed in the past for a projection-type display device having a simpler structure. This demand is not limited to projection-type display devices and includes other color-image display devices featuring modulation panels.

SUMMARY OF THE INVENTION

Accordingly, an object of the present invention is to provide a color-image display device configured differently than in the past, and to provide a modulation panel therefor.

In order to attain at least part of the above and other objects of the present invention, there is provided an image display device for displaying color images. The image display device comprises: an optical illumination system is capable of emitting three-color illumination light including red light, green light, and blue light; an image display unit including a modulation panel having a plurality of pixels that allow illumination light emitted by the optical illumination system to be modulated in accordance with supplied drive signals; and a controller that controls the optical illumination system and the modulation panel. The modulation panel including for each pixel: a drive signal storage section that stores the drive signals corresponding to the three colors used for modulating individual components of the three-color illumination light; a color selection section that selects one of the drive signals stored in the drive signal storage section; and a modulation-executing section that performs modulation in accordance with the drive signal selected by the color selection section. The controller controls the lighting of the optical illumination system such that the modulation panel is illuminated with the three-color illumination light in a recurring fashion one color at a time, and controls the color selection section such that one of the drive signals stored in the drive signal storage section is applied to the modulation-executing section while being switched in synchronism with the lighting timing of the three-color illumination light.

With such an image display device, drive signals for three colors are stored in the drive signal storage section of each pixel, making it possible to display color images with a single-plate modulation panel by individually selecting these signals and feeding them to a modulation-executing section.

The drive signal storage section for each pixel may include: a first switching circuit connected to a data line for feeding the drive signals; a primary storage section that stores the drive signals fed to the first switching circuit; a second switching circuit connected to the output side of the primary storage section; and a secondary storage section connected to the color selection section and designed for storing the drive signals fed from the primary storage section via the second switching circuit.

With such a structure, the drive signals used in a subsequent modulation cycle can be stored in a primary storage section while modulation is performed in accordance with drive signals stored in a secondary storage section. It is therefore possible to reduce the need for shortening the time during which illumination light is on in order to transfer drive signals to each pixel, and to extend the period during which the illumination light is on. As a result, brighter color images can be obtained.

The data line may include three data lines for feeding the drive signals; and the first switching circuit may simultaneously transfer to the primary storage section the drive signals fed through the three data lines in a simultaneous and parallel fashion.

The structure and operation of the control section can thus be simplified by feeding the drive signals for the three colors in parallel to a single-plate modulation panel.

It is preferable that the second switching circuit is supplied with an on/off control signal common to all the pixels included in the modulation panel.

The drive signals of the three colors can thus be simultaneously transferred from the primary storage section to the secondary storage section for all the pixels on the single-plate modulation panel. As a result, the drive signals for performing the next modulation cycle can be easily accumulated in the secondary storage section.

It is preferable that the three-color illumination light is switched such that the illumination light of each color is selected N times (where N is a natural number) within a single vertical synchronization period and is caused to illuminate the single-plate modulation panel.

Images of all colors can thus be displayed in a balanced manner, making it possible to display highly balanced color images.

The present invention may be realized as an image display device, projection-type display device, modulation panel, electrooptical device, or other type of device.

These and other objects, features, aspects, and advantages of the present invention will become more apparent from the following detailed description of the preferred embodiments with the accompanying drawings.

DESCRIPTION OF THE PREFERRED EMBODIMENTS

A. First Embodiment

A1. Overall Structure of the Device

Figure 1:
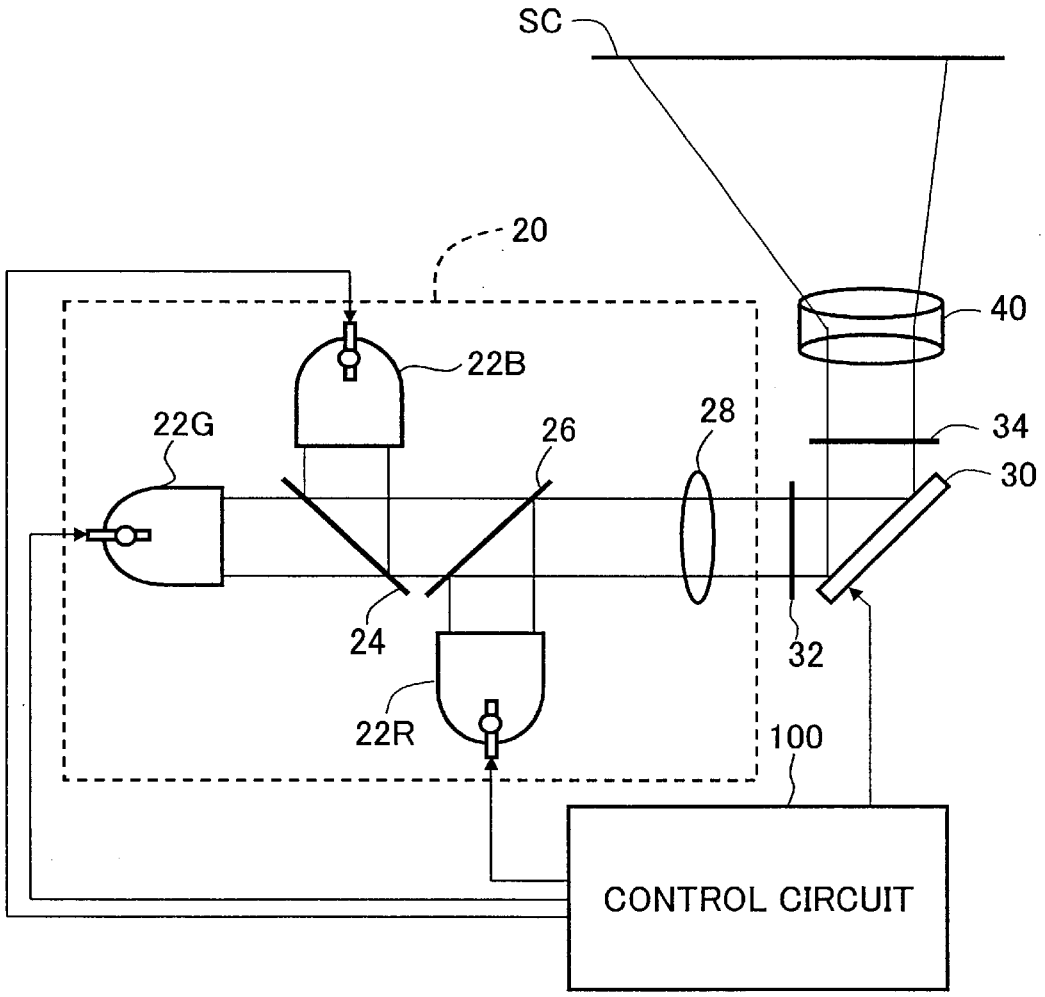
FIG. 1 is a block diagram depicting the overall structure of an image display device pertaining to a first embodiment.

The present invention will now be described through embodiments. FIG. 1 is a block diagram depicting the overall structure of an image display device constructed as a first embodiment of the present invention. This image display device is a so-called projection-type display device, or projector, comprising an illumination device 20, a single-plate liquid-crystal panel 30, an optical projection system 40 for projecting the image light modulated by the liquid-crystal panel 30 onto a screen SC, and a control circuit 100. Polarizing plates 32 and 34 are provided along the optical path on the incident and exit sides of the liquid-crystal panel 30. The liquid-crystal panel 30 may also be referred to herein as "a modulation panel 30."

The illumination device 20 has three light sources 22R, 22G, and 22B; two dichroic mirrors 24 and 26; and a collimating lens 28. The three light sources 22R, 22G, and 22B are selectively switched on one at a time, each emitting illumination light of one of three colors (RGB).

Green light passes through the first and second dichroic mirrors 24 and 26 and illuminates the modulation panel 30. Blue light reflects from the first dichroic mirror 24, passes through the second dichroic mirror 26, and illuminates the modulation panel 30. Red light reflects from the second dichroic mirror 26 and illuminates the modulation panel 30. Consequently, all the illumination light emitted by the three light sources 22R, 22G, and 22B can illuminate the modulation panel 30.

The collimating lens 28 is designed to make the illumination light incident on the liquid-crystal panel 30 more parallel. Consequently, the collimating lens 28 can be dispensed with if the illumination light emitted by the three light sources 22R, 22G, and 22B is sufficiently parallel.

Devices obtained by providing color filters to the outputs of lamps for emitting white light may, for example, be used as the light sources 22R, 22G, and 22B. Lamps capable of periodic flashing and referred to as "flash lamps" or "pulse lamps" are particularly preferable as the aforementioned lamps. This is because such lamps are controlled to flash in short cycles of about 1/60 second (or 1/120second), as described below. Xenon lamps may be used as such flash lamps or pulse lamps.

Three lamps emitting white light may also be used as the three light sources 22R, 22G, and 22B. In this case as well, the modulation panel 30 can be sequentially illuminated with three-color illumination light by the operation of the two dichroic mirrors 24 and 26 in the same manner as when three lamps emitting illumination light of three different colors are used.

The liquid-crystal panel 30 is used as a reflecting light valve (also called "a light modulator" or "a light modulation panel") for reflecting illumination light as it is being modulated. The liquid-crystal panel 30 is illuminated in a recurring manner with three-color illumination light because of the sequential flashing of each of the three light sources 22R, 22G, and 22B. In addition, the control circuit 100 switches the color components of the drive signals (also referred to as "data signals") used for the liquid-crystal panel 30 in synchronism with the switching timing of the colors in the illumination light of the liquid-crystal panel 30. As a result, the three primary colors (RGB) can be displayed in a recurring fashion on the screen SC. The light sources 22R, 22G, and 22B have a flashing frequency of about 60 Hz and are switched sufficiently rapidly for visual perception, creating an illusion of a color image for the viewer.

The liquid-crystal panel 30 and optical projection system 40 in the projection-type display device correspond to an image display device in the present invention.

Figure 2:
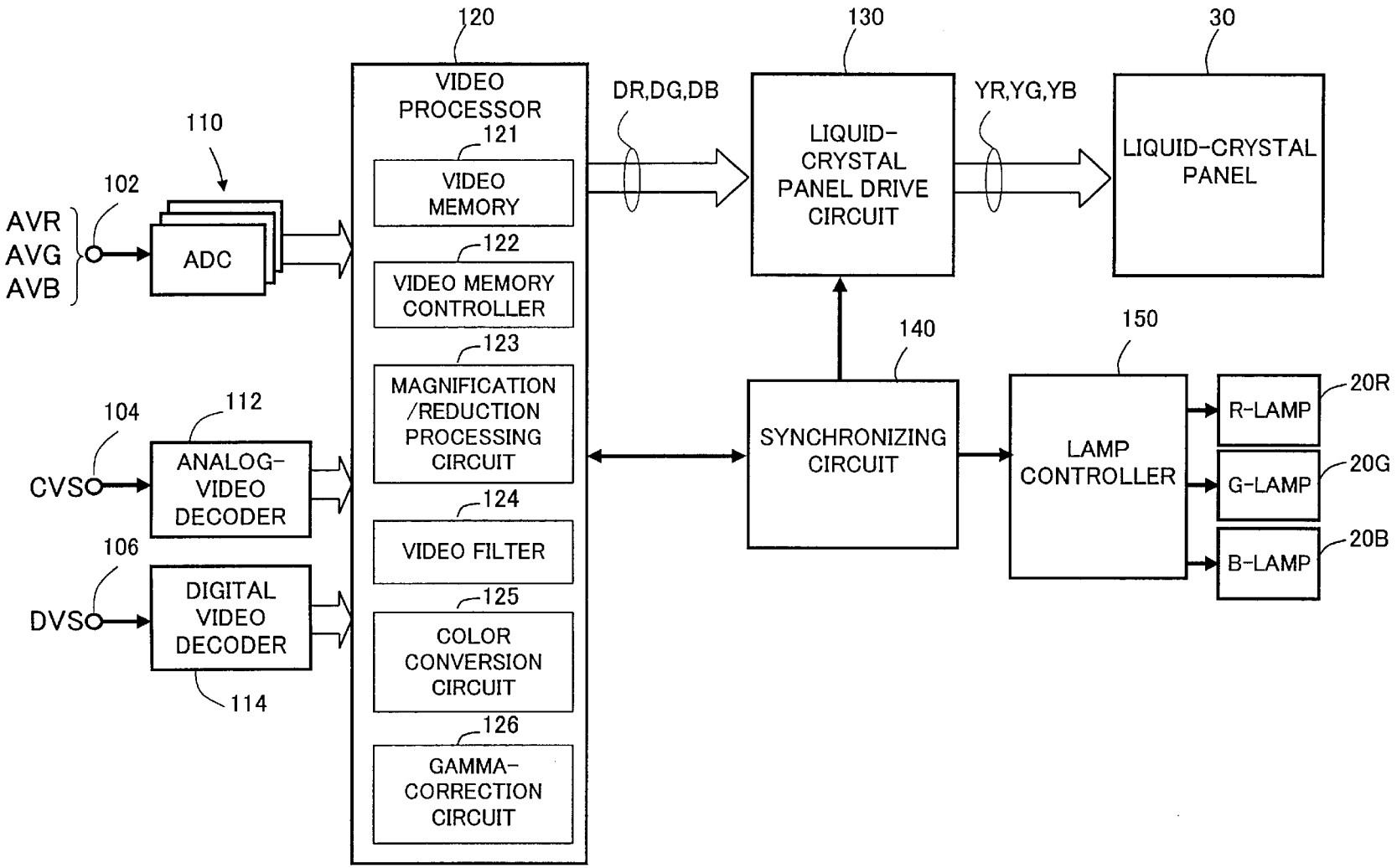
FIG. 2 is a block diagram depicting the internal structure of the control circuit 100.

FIG. 2 is a block diagram depicting the internal structure of the control circuit 100. The control circuit 100 is a computer system comprising a component analog video input terminal 102; a composite analog video input terminal 104; a digital video input terminal 106; and A-D converter 110; an analog-video decoder (synchronizing separator circuit) 112; a digital video decoder 114; a video processor 120; a liquid-crystal panel drive circuit 130 for actuating the liquid-crystal panel 30; a synchronizing circuit 140; and a lamp controller 150 for controlling the three light sources 22R, 22G, and 22B. Any of the three video signals input to the three input terminals 102, 104, and 106 can be selectively used as input video signals.

The video processor 120 has a video memory 121, a video memory controller 122, a magnification/reduction processing circuit 123, a video filter circuit 124, a color conversion circuit 125, and a gamma-correction circuit 126. The circuits 123–126 are each composed of a dedicated hardware circuit. Alternatively, the function of these circuits 123–126 may be implemented by a CPU (not shown), inside the video processor 120, executing computer programs.

The video signals input to the video processor 120 are temporarily stored in the video memory 121, and are fed to the liquid-crystal panel drive circuit 130. The video processor 120 performs enlargement/reduction, filtering, color conversion, gamma correction, and various other types of video processing for the input video signals in the period between such read and write operations. The liquid-crystal panel drive circuit 130 produces drive signals YR, YG, and YB (also referred to as "data signals" and "video data signals") for actuating the liquid-crystal panel 30 in accordance with the video signals DR, DG, and DB supplied. The liquid-crystal panel 30 modulates the three-color illumination light in accordance with these drive signals YR, YG, and YB.

A2. Circuit Structure of Liquid-crystal Panel 30

Figure 3:
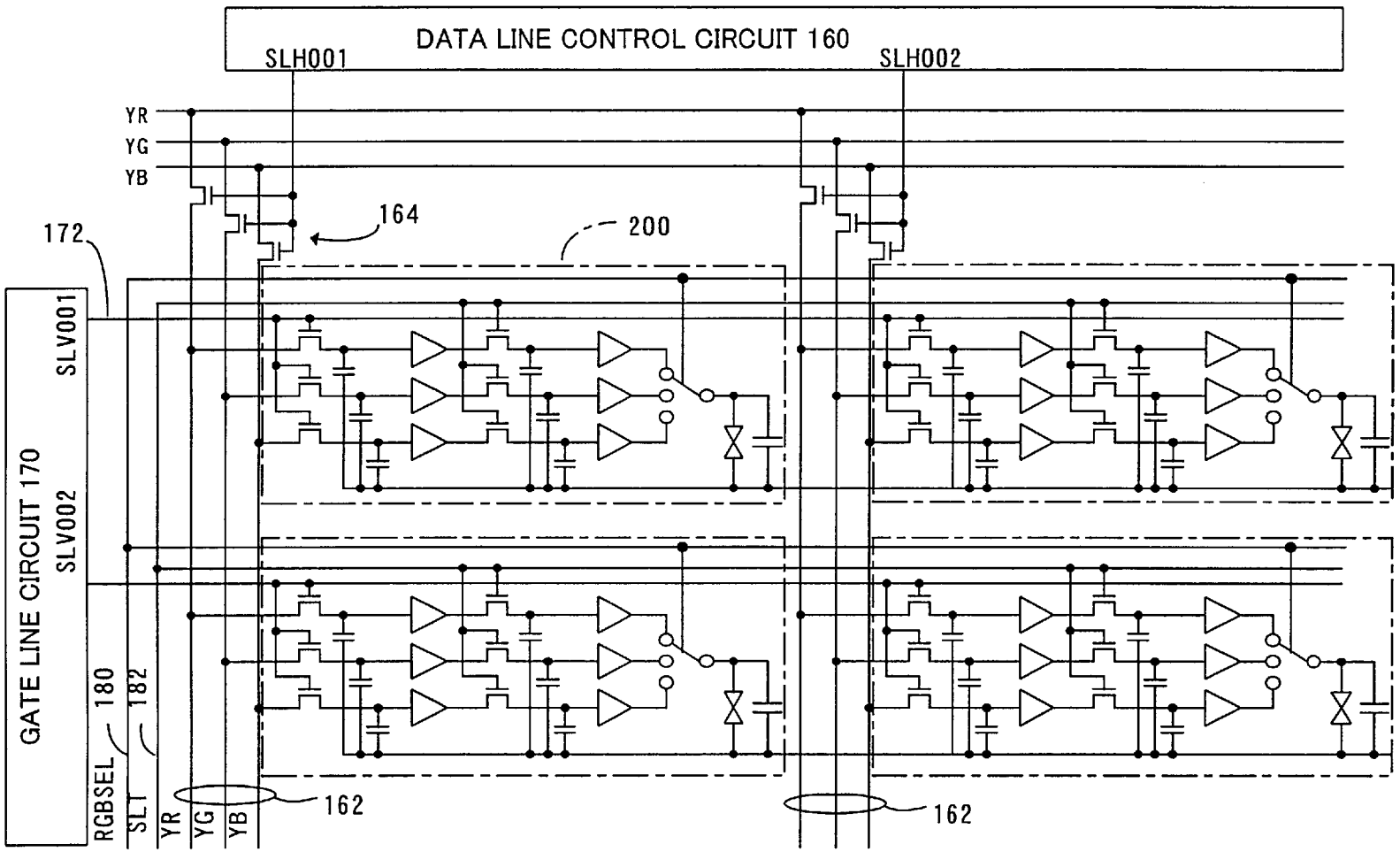
FIG. 3 is a circuit diagram of the liquid-crystal panel 30 according to the first embodiment.

FIG. 3 is a circuit diagram of the liquid-crystal panel 30 according to the first embodiment. This liquid-crystal panel 30 has a data line control circuit 160 and a gate line control circuit 170. The circuits 200 inside the dashed lines are circuits for individual pixels. These single-pixel circuits 200 will hereinafter be referred to as "cells." These structures will be described in detail below.

The cells 200 are arranged in a matrix. Each column of the cell matrix is provided with three data lines 162 for transmitting the three-color drive signals YR, YG, and YB, respectively. The three data lines 162 of each column are provided with three data line switches 164 for switching on and off the three data lines. In addition, each row of the cell matrix is provided with a single gate line 172.

Figure 4:
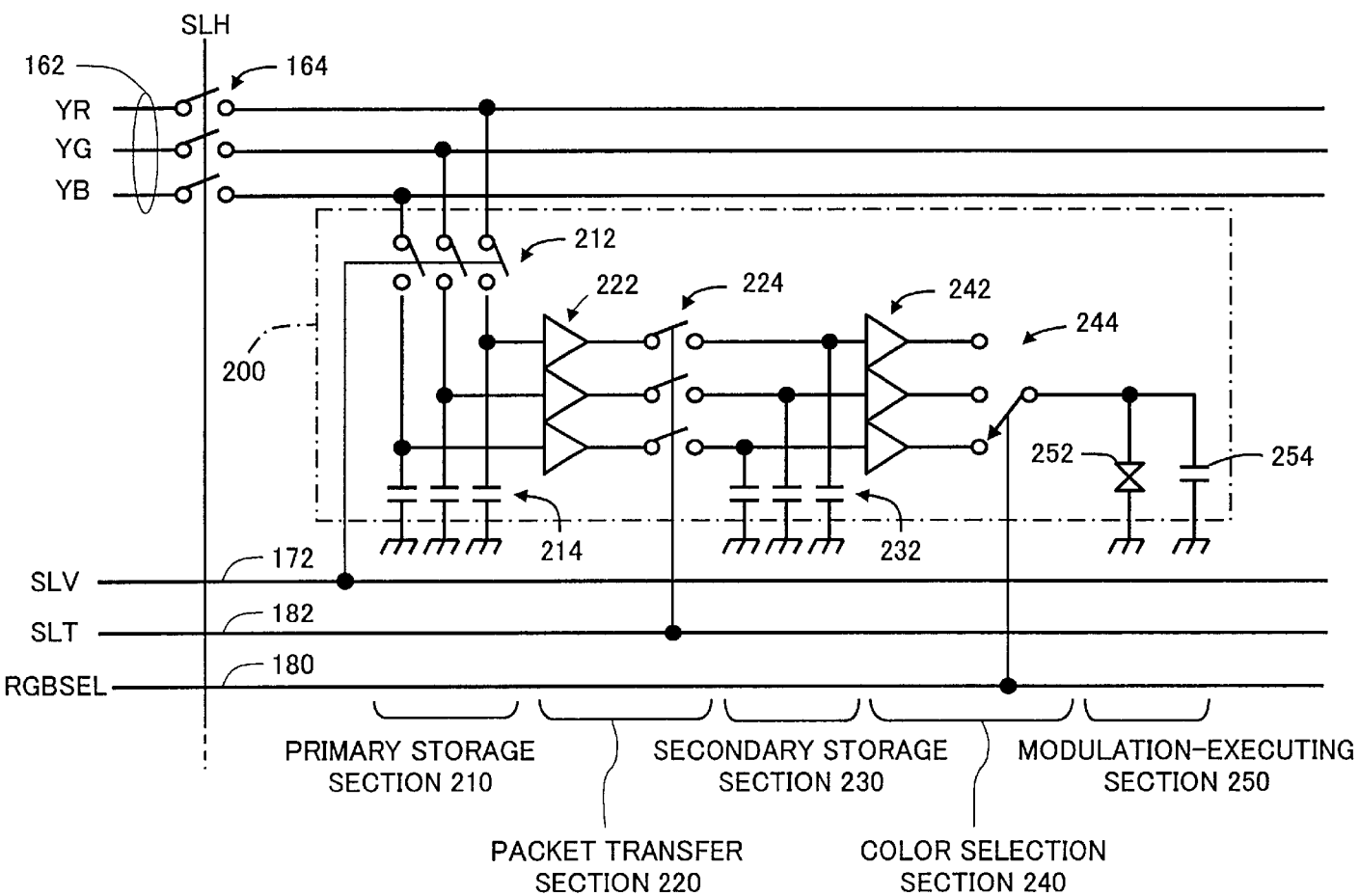
FIG. 4 is a circuit diagram of a single cell in the liquid-crystal panel of the first embodiment.

FIG. 4 is a circuit diagram of a single cell 200 according to the first embodiment. The cell 200 can be divided into a primary storage section 210, a packet transfer section 220, a secondary storage section 230, a color selection section 240, and a modulation-executing section 250. The primary storage section 210 has first gates 212 and first storage capacitors 214, which are connected in series between a data line 162 and a ground wire. Three data lines 162 are provided for the respective drive signals YR, YG, and YB corresponding to the three colors RGB, and three first gates 212 and three first storage capacitors 214 are provided for the respective three data lines. The packet transfer section 220 has three first buffer circuits 222 whose input terminals are connected to the respective nodal points between the storage capacitors 214 and the gates 212 of the primary storage section 210, and three secondary gates 224 connected to the respective output terminals of the buffer circuits 222. The secondary storage section 230 has three second storage capacitors 232 that are connected between the ground wire and the corresponding output terminals of the secondary gates 224 in the packet transfer section 220. The color selection section 240 has three secondary buffer circuits 242 whose input terminals are connected to the respective nodal points between the gates 224 and the second storage capacitors 232 of the packet transfer section 220, and a selector 244 for selecting and outputting one output from among the outputs of the three buffer circuits 242. The modulation-executing section 250 has a single-pixel liquid crystal 252 and a storage capacitance 254 connected in parallel between the ground wire and the output terminal of the selector 244.

The three data line switches 164 are simultaneously switched on or off in accordance with the horizontal gate signal SLH fed from the data line control circuit 160 (FIG. 3) to each column of the cell matrix. As a result, three-color drive signals YR, YG, and YB are simultaneously fed to the three data lines 162 connected to the plurality of cells constituting a single column.

A vertical gate signal SLV is fed from the gate line control circuit 170 (FIG. 3) to the three first gates 212 of each cell via the gate line 172. This vertical gate signal SLT is fed to respective rows of the cell matrix. As a result, the plurality of first gates 212 in a single row are simultaneously switched on or off.

A packet transfer signal SLT is fed from the liquid-crystal panel drive circuit 130 (FIG. 2) to the secondary gates 224 via a packet transfer signal line 182. This packet transfer signal SLT is simultaneously fed to all the cells of the liquid-crystal panel 30. A color selection signal RGBSEL is fed from the liquid-crystal panel drive circuit 130 to the selector 244 via a color selection signal line 180. This color selection signal SEL is also fed simultaneously to all the cells of the liquid-crystal panel 30.

Figure 5:
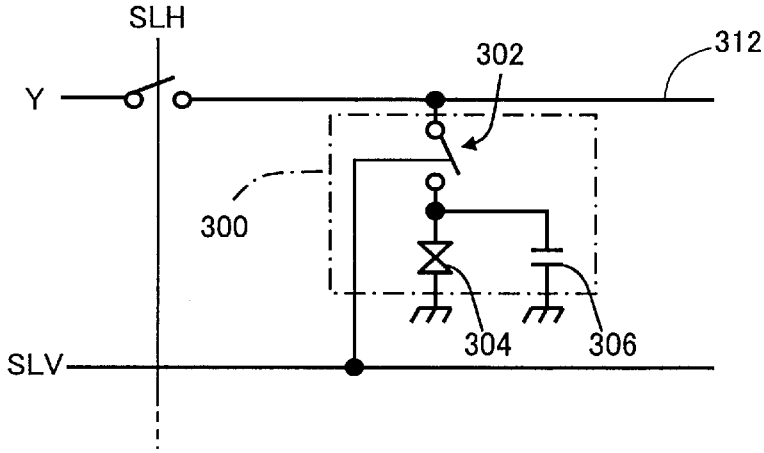
FIG. 5 is a circuit diagram of a single cell in a conventional liquid-crystal panel.

FIG. 5 depicts a single cell of a conventional liquid-crystal panel. This single cell 300 operates on an active matrix drive principle and comprises a gate 302, a liquid crystal 304, and a storage capacitor 306. It can be seen that the cell 200 of the first embodiment depicted in FIG. 4 has a considerably more complex structure than does the conventional cell. In the conventional liquid-crystal panel, only one data line 312 is provided to a column, and the packet transfer signal line 182 or the color selection signal line 180 is absent therefrom.

The liquid-crystal panel 30 of the first embodiment depicted in FIGS. 3 and 4 can be operated such that the drive signals YR, YG, and YB for the three colors RGB are first stored simultaneously as a packet in each cell, and the drive signal for each color component is then applied to the liquid crystal 252 in accordance with the lighting timing of the light sources 22R, 22G, and 22B for the three colors, as described below.

A3. Operation of Liquid-Crystal Panel 30

Figure 6:
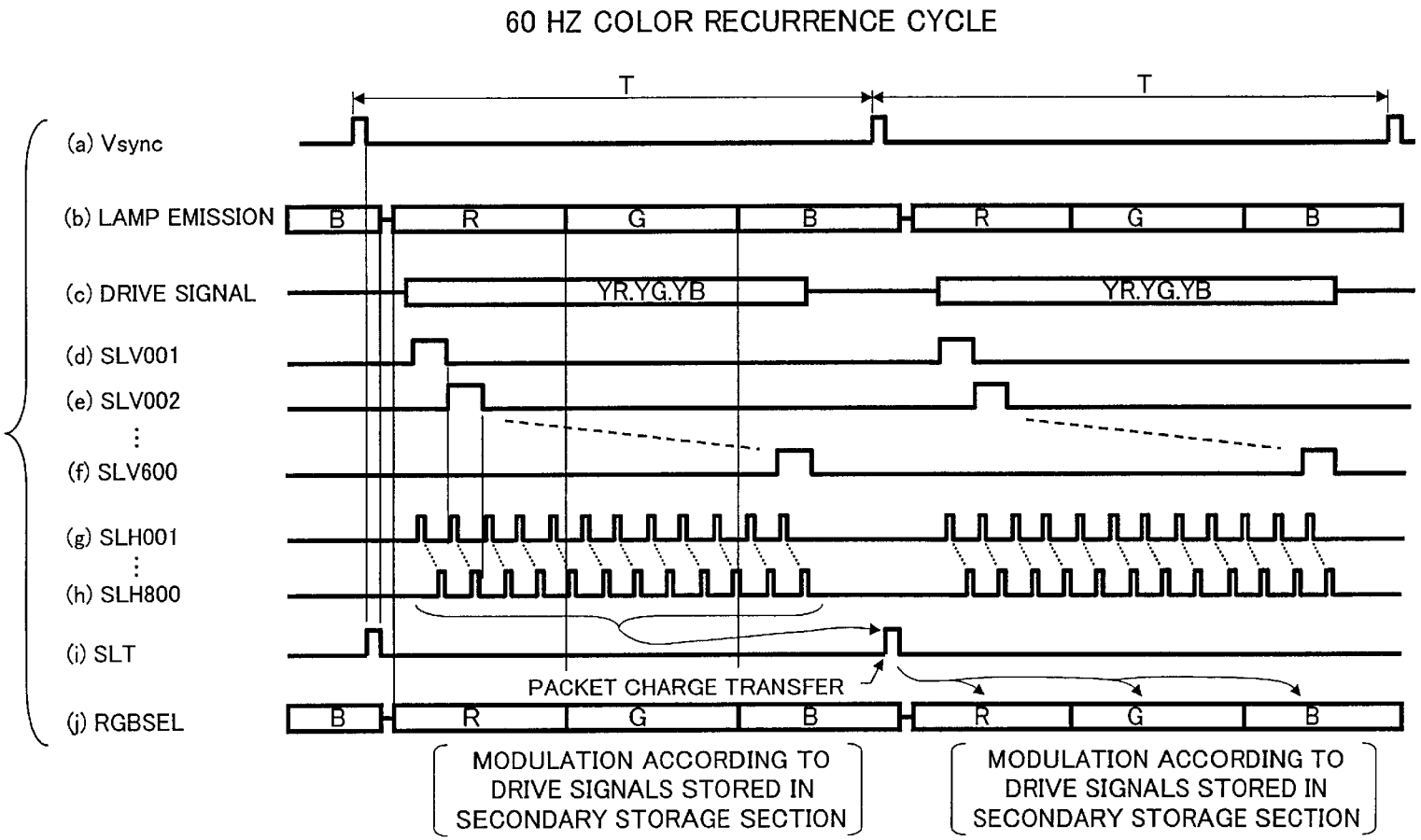
FIG. 6 is a timing chart depicting an operating example of the liquid-crystal panel 30 pertaining to the first embodiment.

FIG. 6 is a timing chart depicting the operation of the liquid-crystal panel 30 pertaining to the first embodiment. In this example, the vertical synchronizing signal Vsync (FIG. 6*a*) used for display purposes is 60 Hz, and the three light sources 22R, 22G, and 22B are controlled such that the sources are switched on one at a time with the same period (that is 60 Hz) as the vertical synchronization period T (FIG. 6*b*). Thus, the three light sources 22R, 22G, and 22B having a lighting frequency of 60 Hz will thus be referred to as "having a color recurrence cycle of 60 Hz."

The vertical synchronizing signal Vsync is generated inside the video processor 120 together with a horizontal synchronizing signal and a dot clock signal (not shown), and is fed to the liquid-crystal panel drive circuit 130 or synchronizing circuit 140. The synchronizing circuit 140 adjusts the operation of the liquid-crystal panel drive circuit 130 and the lamp controller 150 in accordance with these synchronizing signals to achieve a synchronized performance.

Generating a single pulse of the vertical synchronizing signal Vsync causes the vertical gate signals SLV001 to SLV600 (FIGS. 6(*d*) to 6(*f*)) to sequentially reach an H-level one at a time in a single vertical synchronization period T. While each gate signal SLV is kept in an H-level condition, horizontal gate signals SLH001 to SLH800 (FIGS. 6(*g*) and 6(*h*)) are sequentially brought to an H-level one at a time. It is assumed here that the liquid-crystal panel 30 measures 600×800 pixels. In addition, some of the vertical gate signals SLV001 to SLV600 or horizontal gate signals SLH001 to SLH800 are omitted from the drawing for the sake of convenience. There is no need for the horizontal gate signals SLH001 to SLH800 to be brought to the H-level one at a time, and horizontal gate signals SLH corresponding to a number of columns may be brought to the H-level all at the same time.

When a single vertical gate signal SLV reaches the H-level, all the first gates 212 (FIG. 4) of the corresponding row are switched on. The data line switches 164 of a single cell are switched on when a single data line switch signal SLH reaches the H-level in this state. As a result, three-color drive signals YR, YG, and YB are accumulated in the storage capacitors 214 of the cell. In the liquid-crystal panel drive circuit 130 (FIG. 2), the three-color drive signals YR, YG, and YB to be applied to each cell are fed via the three data lines 162 in synchronism with the timing according to which the horizontal gate signals SLH001 to SLH800 reach an H-level. Consequently, the three-color drive signals YR, YG, and YB are then stored in the corresponding cells when the horizontal gate signals SLH001 to SLH800 sequentially reach the H-level.

A packet transfer signal SLT (FIG. 6(*i*)) is thus commonly fed to all the cells of the liquid-crystal panel 30 after the three-color drive signals YR, YG, and YB have been accumulated in the first storage capacitors 214 of all the cells of an array having 600×800 pixels. The feeding is done before the lamps start emitting light during the subsequent vertical synchronization period T. When the packet transfer signal SLT reaches an H-level, the gates 224 of the packet transfer section 220 in each cell (FIG. 4) are switched on, with the result that the drive signals YR, YG, and YB stored in the first storage capacitors 214 are simultaneously accumulated by being fed as a packet to the second storage capacitors 232 via the buffer circuits 222.

The three-color drive signals YR, YG, and YB stored in the second storage capacitors 232 are then used to display images having various color components. Specifically, the selector 244 in a cell is switched over and the drive signal YR of the R-component is fed from the second storage capacitors 232 to the liquid crystal 252 and the storage capacitance 254 via the buffers 242 when the color selection signal RGBSEL (FIG. 6*j*) reaches the level at which the R-component is selected after the packet transfer signal SLT has reached the H-level. As a result, the liquid crystals 252 of all the cells in a liquid-crystal panel are presented with the R-component drive signal YR fed in advance to each cell. The color selection signal RGBSEL (FIG. 6*j*) is then sequentially switched to the levels at which the G- and B-components are selected, and the G- and B-component drive signals YG and YB are sequentially fed from the second storage capacitors 232 to the liquid crystal 252 and storage capacitance 254 via the buffer 242 in accordance therewith. The switching timing of the color selection signal RGBSEL is synchronized with the lighting timing (FIG. 6*b*) of the three-color lamps. Consequently, the liquid-crystal panel 30 performs optical modulation such that three-color images are displayed while being switched in accordance with a color recurrence cycle of 60 Hz. As a result, the three-color images are sequentially switched and displayed on the screen SC (FIG. 1) with a period of about 1/180 second, and are observed as color images by the unaided eye.

Figure 7:
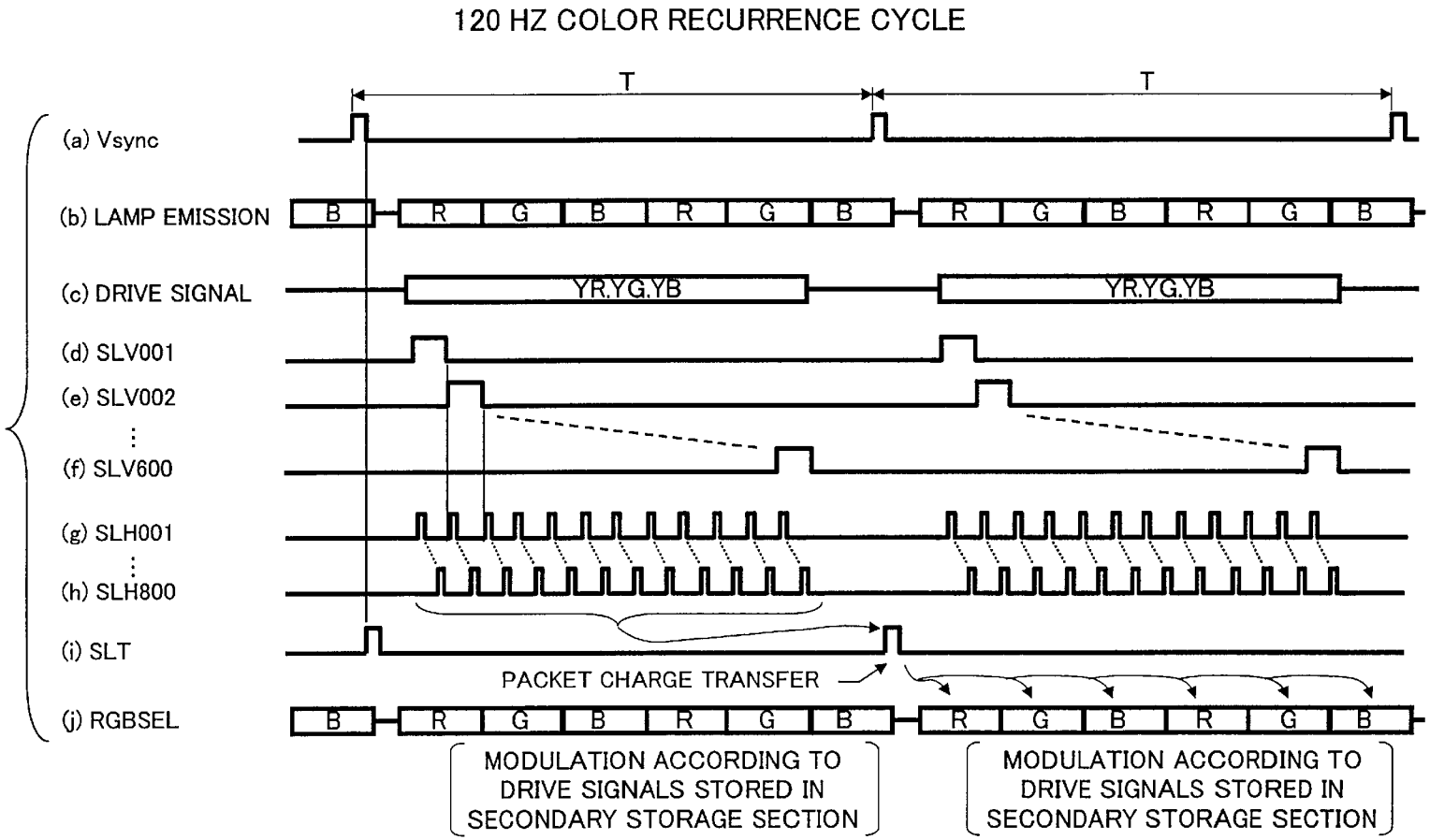
FIG. 7 is a timing chart depicting another operating example of the liquid-crystal panel 30 pertaining to the first embodiment.

FIG. 7 depicts the operation of the liquid-crystal panel 30 for a color recurrence cycle of 120 Hz. The signals in FIGS. 7(*a*) and FIGS. 7(*c*) to 7(*i*) are the same as the signals in FIGS. 6(*a*) and FIGS. 6(*c*) to 6(*i*), and only the timing according to which the lamps emit light in FIG. 7(*b*) and the timing of the color selection signal RGBSEL in FIG. 7(*j*) are different from those in FIG. 6. Specifically, in FIG. 7 the color lamps are sequentially switched on and off with a period of about 1/360second. As a result, three-color images are sequentially switched and displayed on the screen SC with a period of about 1/360second. In FIG. 7, the lighting period of a single color is shorter than in FIG. 6 but the display term of each color is the same as in FIG. 6. It is therefore possible to display substantially the same color images as in FIG. 6.

Illumination light of three colors should be switched in a recurring fashion such that the illumination light of each color is selected N times (where N is a natural number) in the course of a single vertical synchronization period. Images of each color can thus be displayed in a balanced manner, making it possible to display highly balanced color images.

The liquid crystal 252 of each cell is thus modulated in accordance with the three-color drive signals YR, YG, and YB stored in the secondary storage section 230, and the drive signals YR, YG, and YB used during the subsequent vertical synchronization period are accumulated at the same time in the primary storage section 210. In the first embodiment, therefore, there is no need for lamps to be switched off in order to transfer drive signals, and the illumination light of each color can be kept on for a long time. As a result, brighter images can be displayed.

One of the advantages of the projection-type display device pertaining to the first embodiment is that the structure of the optical system is much simpler than that of a conventional three-plate projection-type display device, making it easier to obtain a device that is compact overall. Another advantage is that higher light utilization efficiency than in the case of a conventional projection-type display device can be achieved because the optical path between the light source and the optical projection system is short and the optical loss between them is low. In addition, the high light utilization efficiency makes it possible to set the output of the light source below that of the light source in a conventional device. Still another advantage is that the lifetime of the optical system can be extended severalfold by setting the output of the light source below the conventional level.

B. Second Embodiment

Figure 8:
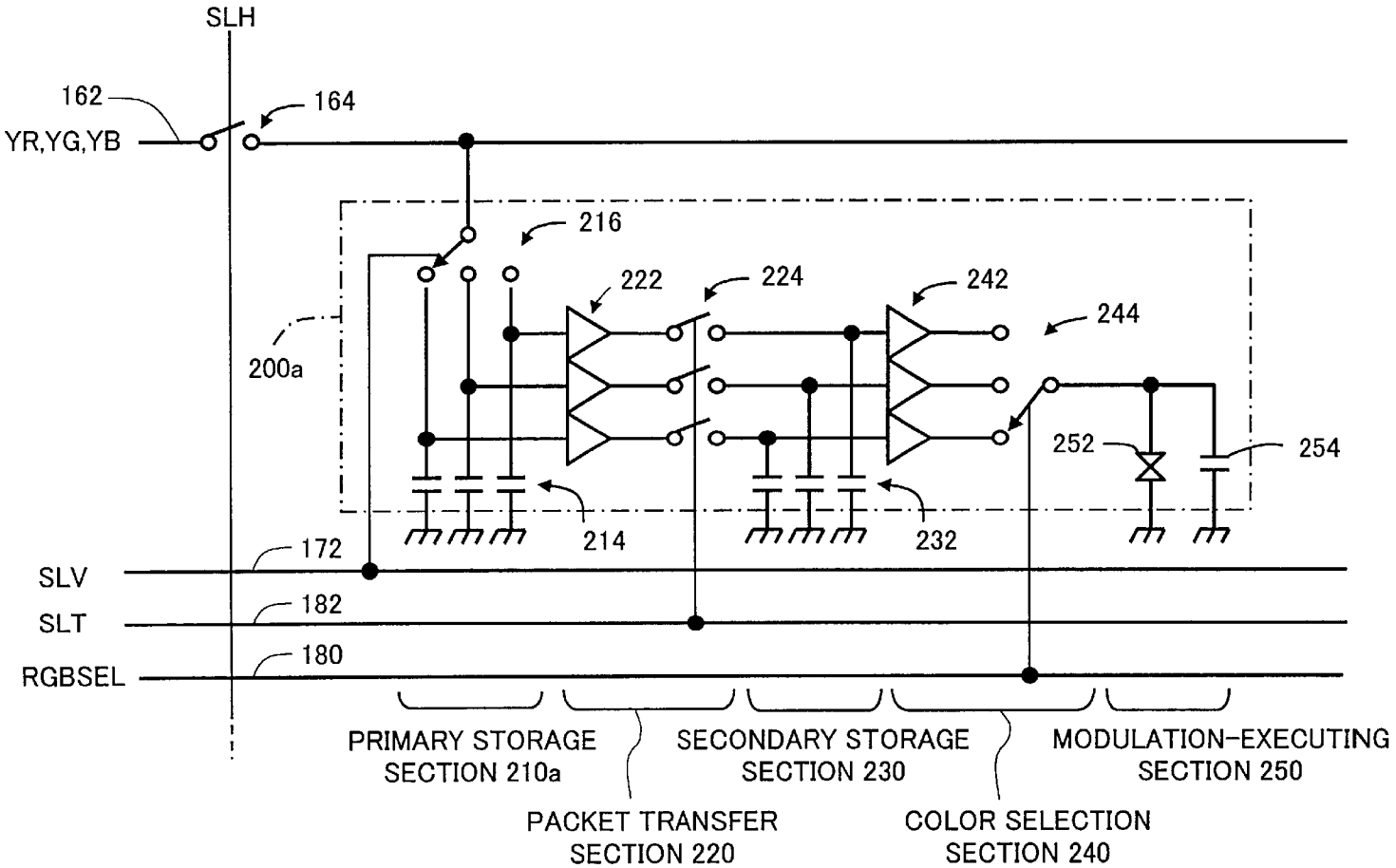
FIG. 8 is a circuit diagram of a single cell in the liquid-crystal panel of a second embodiment.

FIG. 8 is a circuit diagram of a cell according to a second embodiment. The second embodiment differs from the first embodiment solely by the circuitry inside the liquid-crystal panel, with the rest of the structure being the same as in the first embodiment.

The single-cell circuit 200*a* shown in FIG. 8 differs from the single-cell cell 200 shown in FIG. 4 solely by the structure of the primary storage section 210, with the rest of the structure being the same. Specifically, the primary storage section 210*a* of FIG. 8 is provided with a single selector 216 in place of the three gates 212 in the primary storage section 210 of FIG. 4. In addition, the circuit of the liquid-crystal panel shown in FIG. 8 is provided with a single data line 162 and a single data line switch 164. Consequently, the three-color drive signals YR, YG, and YB are fed one color at a time via the single data line 162.

Figure 9:
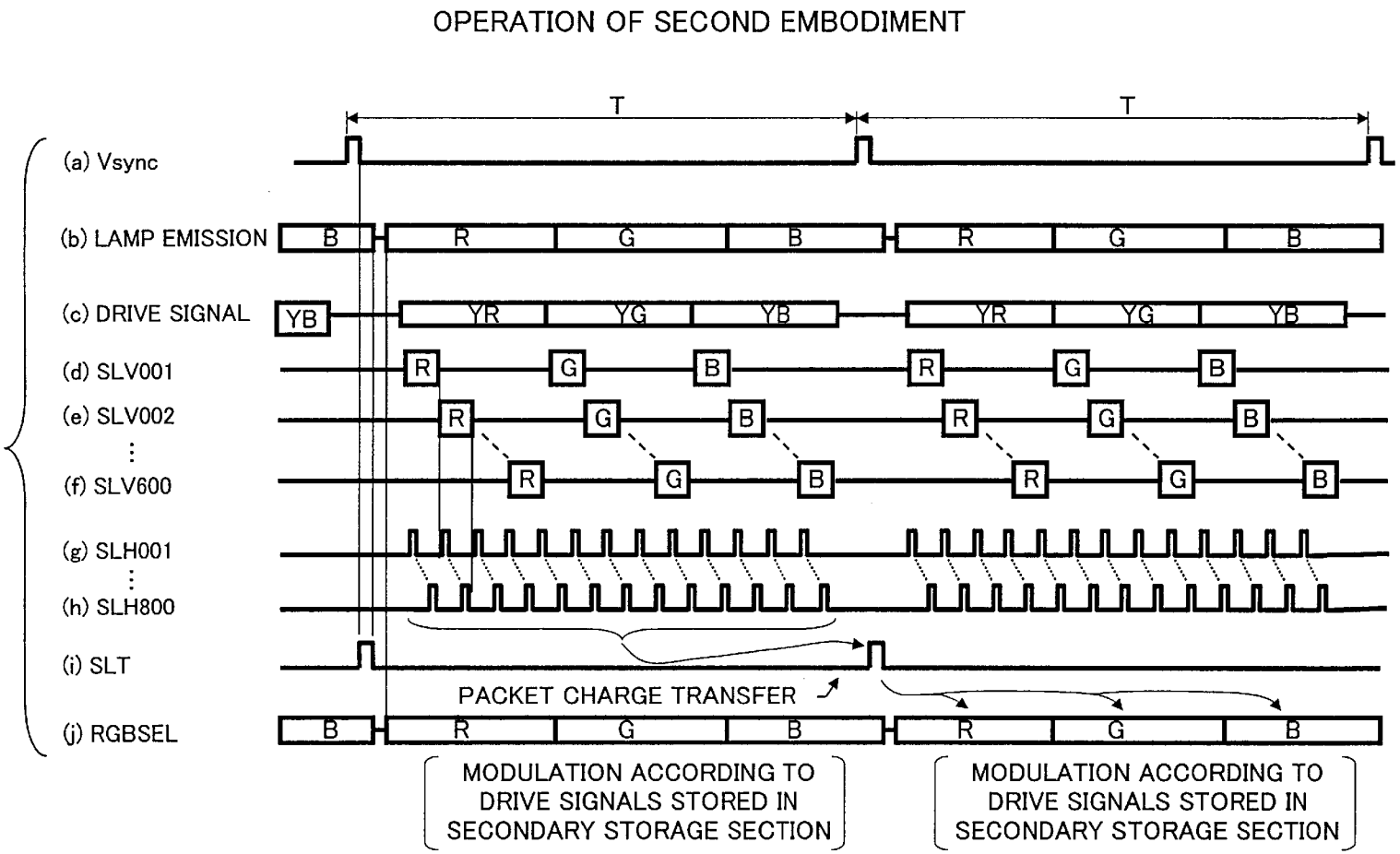
FIG. 9 is a timing chart depicting an operating example of the liquid-crystal panel 30 pertaining to the second embodiment.

FIG. 9 is a timing chart depicting the operation of the liquid-crystal panel pertaining to the second embodiment. The depiction corresponds to the operation of the first embodiment shown in FIG. 6. FIG. 9 is substantially the same as FIG. 6 except that the drive signals (FIG. 9(*c*)) and the horizontal gate signals (FIGS. 9(*d*) to 9(*g*)) are different from those in FIG. 6. Specifically, three-color drive signals YR, YG, and YB are fed to each cell one color at a time, as shown in FIG. 9(*c*). The selector 216 of the primary storage section 210*a* is switched in accordance with the color components supplied, and the drive signals are accumulated in the first storage capacitors 214 for the various color components. The system operates in the same manner as in FIG. 6 after the three-color drive signals YR, YG, and YB have been stored in the primary storage sections 210*a* of all cells. Specifically, the three-color drive signals IR, YG, and YB stored in the primary storage sections 210*a* are simultaneously transferred as a packet to secondary storage sections 220 after a pulsed packet transfer signal SLT has been produced but before the lamps have been switched on. Modulation is then performed according to the drive signals stored in the secondary storage sections 220.

The second embodiment is similar to the first embodiment in the sense that there is no need to switch off lighted lamps in order to transfer drive signals, allowing the illumination light of each color to remain on for a long time and making it possible to display brighter images. The first embodiment entails inputting the three-color drive signals YR, YG, and YB in parallel to the liquid-crystal panel, and is thus advantageous in that the structure or operation of the liquid-crystal panel drive circuit 130 is simpler than in the second embodiment. An advantage of the second embodiment, on the other hand, is that there is no need to provide the liquid-crystal panel with three data lines, with a single data line being sufficient.

C. Other Embodiments

Figure 10:
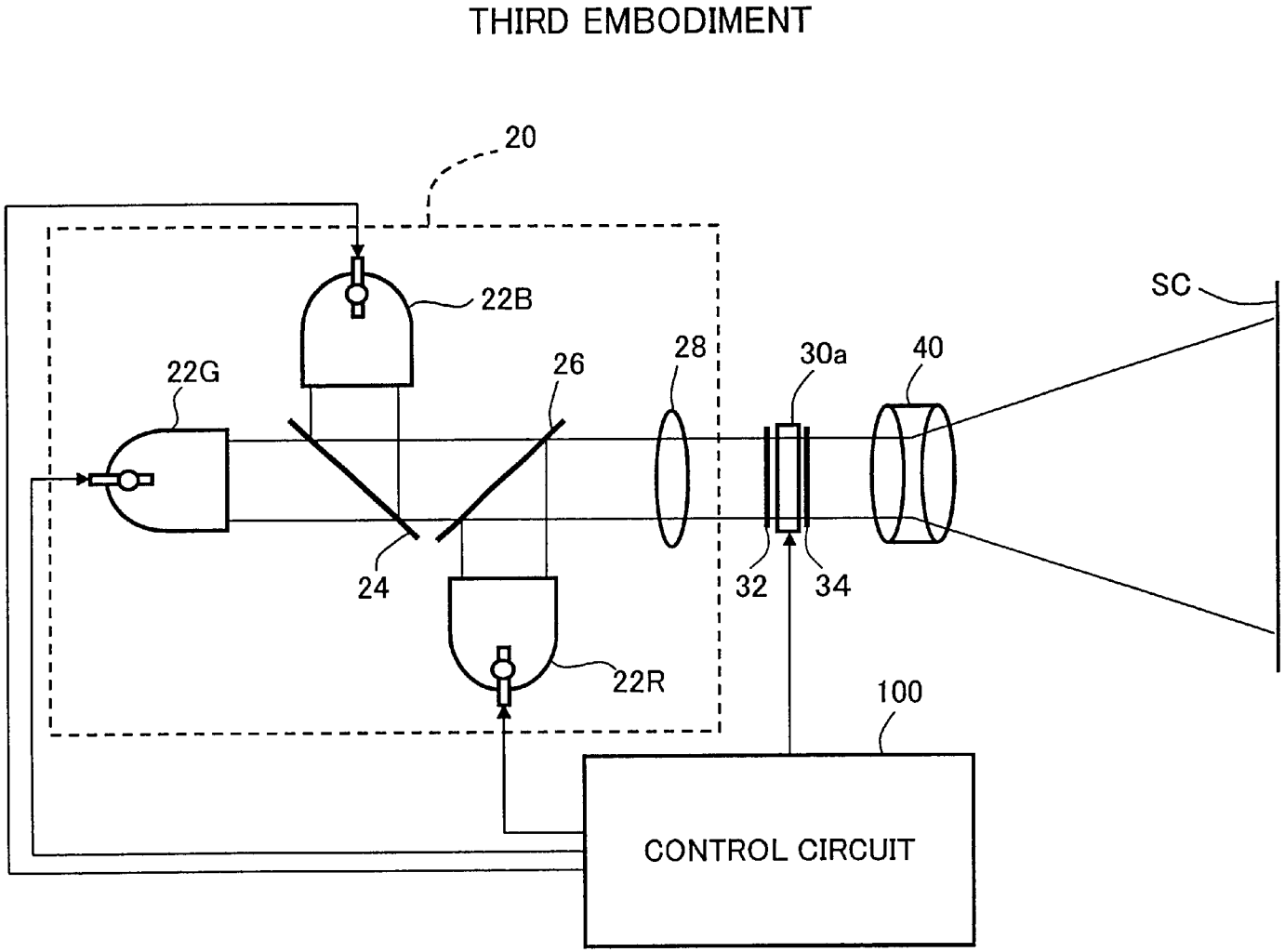
FIG. 10 is a block diagram depicting the overall structure of an image display device pertaining to a third embodiment.

FIG. 10 is a block diagram depicting the overall structure of an image display device pertaining to a third embodiment.

A transmission-type liquid-crystal panel 30*a* is used instead of the reflection-type liquid-crystal panel 30 used in the first embodiment depicted in FIG. 1, with the rest of the structure being the same as in the first embodiment. Similar to the first embodiment, the third embodiment allows illumination light of each color to be kept on for a longer time, and brighter images to be displayed.

Constructing the single-cell circuit 200 shown in FIG. 4 with a transmission-type liquid-crystal panel 30*a* creates a possibility that the aperture area rate of the pixels will be significantly lower and that the utilization efficiency of illumination light will decrease. With a reflection-type liquid-crystal panel, on the other hand, substantially all circuits can be disposed near the liquid-crystal panel, preventing the utilization efficiency of illumination light from decreasing in an excessive manner when fairly complex single-cell circuits are used. In this sense, the first embodiment, in which a reflection-type liquid-crystal panel is used, is preferred.

Figure 11:
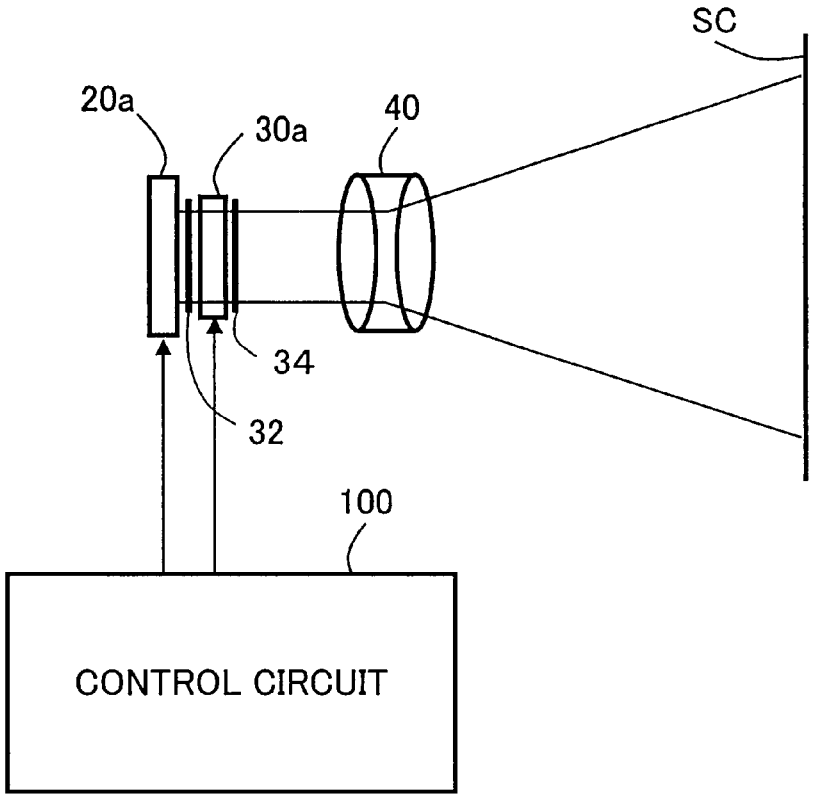
FIG. 11 is a block diagram depicting the overall structure of an image display device pertaining to a fourth embodiment.

FIG. 11 is a block diagram depicting the overall structure of an image display device pertaining to a fourth embodiment. In this image display device, a three-color backlight 20*a* is used instead of the illumination device 20 in the device of the third embodiment shown in FIG. 10, with the rest of the structure being the same as in the third embodiment.

Three-color (RGB) illumination light is emitted by the three-color backlight 20*a* while being sequentially switched with a period of about 1/180 second. An operation that follows a color recurrence cycle such as that shown in FIG. 6 can therefore be performed. The high-speed three-color backlight marketed by Hunet (Shibuya District, Tokyo) may, for example, be used as the three-color backlight 20*a*. As can be seen from this example, a device capable of emitting three-color illumination light (red, green, and blue) should be used as the light source of the optical illumination system, dispensing with the need to use three lamps. Similar to the first and second embodiments, the fourth embodiment allows illumination light of each color to be kept on for a longer time, and brighter images to be displayed.

D. Modified Examples

D1. Modified Example 1

Although the above-described embodiments entailed the use of liquid-crystal panels as the single-plate modulation panels, the present invention can also be adapted to image display devices having modulation panels other than liquid-crystal panels. A modulation panel with emission direction control (in which the direction of emitted light is controlled for each pixel) such as a DMD (Digital Mirror Device, registered trade name of TI) may, for example, be used instead of the reflection-type liquid-crystal panel 30 as the image display device of FIG. 1.

D2. Modified Example 2

Although each of the cells in the above-described embodiments has a primary storage section and a secondary storage section, another option is to provide each cell with a single storage section. However, providing each cell with two or more storage sections for storing three-color drive signals allows illumination light of each color to be kept on for a longer time, and brighter images to be displayed.

D3. Modified Example 3

The present invention may be used with a variety of color image display devices in addition to a projection-type display device. For example, the present invention may be used with a direct-view color image display device that allows the observer to view the modulation panel directly, or with a spatial-image color image display device for observing spatially constructed images. Examples of direct-view color image display devices include computer display devices, automobile-mounted miniature monitors, and digital camera viewfinders. Head-mounted displays may be cited as examples of spatial-image color display devices.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image display device, comprising:

an optical illumination system capable of emitting three-color illumination light including red light, green light, and blue light;

an image display unit including a modulation panel having a plurality of pixels that allow illumination light emitted by the optical illumination system to be modulated in accordance with supplied drive signals; and a controller that controls the optical illumination system and the modulation panel;

the modulation panel including for each pixel:

a drive signal storage section that stores the drive signals corresponding to the three colors used for modulating individual components of the three-color illumination light;

a color selection section that selects one of the drive signals stored in the drive signal storage section; and a modulation-executing section that performs modulation in accordance with the drive signal selected by the color selection section, and wherein the controller controls the lighting of the optical illumination system such that the modulation panel is illuminated with the three-color illumination light in a recurring fashion one color at a time, and controls the color selection section such that one of the drive signals stored in the drive signal storage section is applied to the modulation-executing section while being switched in synchronism with the lighting timing of the three-color illumination light, wherein the drive signal storage section for each pixel includes:

a first switching circuit connected to a data line for feeding the drive signals;

a primary storage section that stores the drive signals fed to the first switching circuit;

a second switching circuit connected to the output side of the primary storage section; and a secondary storage section connected to the color selection section and designed for storing the drive signals fed from the primary storage section via the second switching circuit.

2. An image display device according to claim 1, wherein the data line includes three data lines for feeding the drive signals; and the first switching circuit simultaneously transfers to the primary storage section the drive signals fed through the three data lines in a simultaneous and parallel fashion.

3. An image display device according to claim 1, wherein the second switching circuit is supplied with an on/off control signal common to all the pixels included in the modulation panel.

4. An image display device according to claim 1, wherein the three-color illumination light in the image display device is switched such that the illumination light of each color is selected N times (where N is a natural number) within a single vertical synchronization period and is caused to illuminate the single-plate modulation panel.

5. A modulation panel having a plurality of pixels for performing optical modulation in accordance with supplied drive signals, the modulation panel comprising for each pixel:

a drive signal storage section that stores the drive signals corresponding to the three colors used for modulating individual components of the three-color illumination light;

a color selection section that selects one of the drive signals stored in the drive signal storage section; and a modulation-executing section that performs modulation in accordance with the drive signal selected by the color selection section, wherein the drive signal storage section for each pixel includes:

a first switching circuit connected to a data line for feeding the drive signals;

a primary storage section that stores the drive signals fed to the first switching circuit;

a second switching circuit connected to the output side of the primary storage a secondary storage section connected to the color selection section and designed for storing the drive signals fed from the primary storage section via the second switching circuit.

6. A modulation panel according to claim 5, wherein the data line includes three data lines for feeding the drive signals; and the first switching circuit simultaneously transfers to the primary storage section the drive signals fed through the three data lines in a simultaneous and parallel fashion.

7. A modulation panel according to claim 5, wherein the second switching circuit is supplied with an on/off control signal common to all the pixels included in the single-plate modulation panel.

8. An image display device, comprising:

an optical illumination system capable of emitting a plurality of light beams, each of the plurality of light beams having a different color from each other;

a drive signal storage section that stores a plurality of drive signals;

a selection section that selects one of the plurality of drive signals stored in the drive signal storage section;

a modulation-executing section that modulates one of the plurality of light beams in accordance with the one of the plurality of drive signals; and a controller that controls the lighting of the optical illumination system such that the modulation-executing section is illuminated with the plurality of light beams in a recurring fashion one color at a time, and controls the color selection section such that each of the plurality of drive signals stored in the drive signal storage section is applied to the modulation-executing section in synchronism with the lighting of the optical illumination system, wherein the drive signal storage section for each pixel includes:

a first switching circuit connected to a data line for feeding the drive signals;

a primary storage section that stores the drive signals fed to the first switching circuit;

a second switching circuit connected to the output side of the primary storage section; and a secondary storage section connected to the color selection section and designed for storing the drive signals fed from the primary storage section via the second switching circuit.

9. An image display device according to claim 8, wherein the data line includes three data lines for feeding the drive signals; and the first switching circuit simultaneously transfers to the primary storage section the drive signals fed through the three data lines in a simultaneous and parallel fashion.

10. An image display device according to claim 8, wherein the second switching circuit is supplied with an on/off control signal common to all the pixels included in the modulation panel.

11. An image display device according to claim 8, wherein the three-color illumination light in the image display device is switched such that the illumination light of each color is selected N times (where N is a natural number) within a single vertical synchronization period and is caused to illuminate the single-plate modulation panel.

* * * * *